US011185109B2

(12) United States Patent
Liu

(10) Patent No.: US 11,185,109 B2
(45) Date of Patent: Nov. 30, 2021

(54) ELECTRONIC CIGARETTE COMPRISING A MOUTHPIECE ASSEMBLY, AN ATOMIZATION ASSEMBLY, AND A BASE ASSEMBLY

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 134 days.

(21) Appl. No.: 16/718,234

(22) Filed: Dec. 18, 2019

(65) Prior Publication Data

US 2021/0022392 A1 Jan. 28, 2021

(30) Foreign Application Priority Data

Jul. 26, 2019 (CN) ..... 201910682950.X
Jul. 26, 2019 (CN) ..... 201921200040.5

(51) Int. Cl.
*A24F 40/10* (2020.01)
*A24F 40/40* (2020.01)
*A24B 15/167* (2020.01)

(52) U.S. Cl.
CPC ..... *A24F 40/10* (2020.01); *A24F 40/40* (2020.01); *A24B 15/167* (2016.11)

(58) Field of Classification Search
CPC ..... A24F 40/00; A24F 40/10; A24F 40/40; A24F 40/42
USPC ..... 131/328, 329
See application file for complete search history.

(56) References Cited

U.S. PATENT DOCUMENTS

2019/0357594 A1* 11/2019 Liu ..... H05B 3/44
2020/0178615 A1* 6/2020 Liu ..... A24F 40/42

* cited by examiner

*Primary Examiner* — Hae Moon Hyeon
(74) *Attorney, Agent, or Firm* — Matthias Scholl P.C.; Matthias Scholl

(57) ABSTRACT

An electronic cigarette, including: a mouthpiece assembly, an atomization assembly and a base assembly. The mouthpiece assembly includes a mouthpiece; a limited post; a spring; a fixed ring; an upper cover that is rotatable; a silicone ring; a cylindrical casing; a glass tube; a lower cover. The atomization assembly includes a first electrode; a first sealing joint; a first heating wire; a first piece of cotton; a first fixed seat; a sleeve; a second fixed seat; a second piece of cotton; a second heating wire; a second sealing joint; a second electrode. The base assembly includes a joint; a seal ring; and a base cover. The limited post is disposed in the spring. The cylindrical casing includes a flange provided with a locating hole. The spring is embedded in the locating hole. The fixed ring is disposed in the upper cover to control the rotation of the upper cover.

1 Claim, 6 Drawing Sheets

ELECTRONIC CIGARETTE COMPRISING A MOUTHPIECE ASSEMBLY, AN ATOMIZATION ASSEMBLY, AND A BASE ASSEMBLY

CROSS-REFERENCE TO RELATED APPLICATIONS

Pursuant to 35 U.S.C. § 119 and the Paris Convention Treaty, this application claims foreign priority to Chinese Patent Application No. 201910682950.X filed Jul. 26, 2019 and to Chinese Patent Application No. 201921200040.5 filed Jul. 26, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an electronic cigarette.

Electronic cigarettes atomize nicotine-containing e-liquid.

SUMMARY

The disclosure provides an electronic cigarette.

The electronic cigarette comprises a mouthpiece assembly, an atomization assembly and a base assembly.

The mouthpiece assembly comprises a mouthpiece; a limited post; a spring; a fixed ring; an upper cover that is rotatable; a silicone ring; a cylindrical casing; a glass tube; a lower cover.

The atomization assembly comprises a first electrode; a first sealing joint; a first heating wire; a first piece of cotton; a first fixed seat; a sleeve; a second fixed seat; a second piece of cotton; a second heating wire; a second sealing joint; a second electrode.

The base assembly comprises a joint; a seal ring; and a base cover.

The limited post is disposed in the spring; the cylindrical casing comprises a flange provided with a locating hole; and the spring is embedded in the locating hole; the fixed ring is disposed in the upper cover to control the rotation of the upper cover; the silicone ring is disposed on the cylindrical casing; the upper cover is disposed on the silicone ring; the cylindrical casing is nested in the glass tube; the lower cover is in threaded connection to the cylindrical casing and is disposed on one end of the glass tube; the mouthpiece is disposed on the fixed ring.

The first piece of cotton wraps the first heating wire; the first electrode is disposed on the first sealing joint; the first heating wire and the first sealing joint are disposed on two ends of the first fixed seat, respectively; the first fixed seat is disposed in an upper part of the sleeve; the second piece of cotton wraps the second heating wire; the second electrode is disposed on the second sealing joint; the second heating wire and the second sealing joint are disposed on two ends of the second fixed seat, respectively; the second fixed seat is disposed in a lower part of the sleeve.

The seal ring is sheathed on the joint; and the base cover comprises a central hole and the seal ring and the joint are disposed in the central hole.

The atomization assembly is disposed in the cylindrical casing of the mouthpiece assembly. The base assembly is in threaded connection to the lower cover of the mouthpiece assembly. The atomization assembly comprises a first heating wire and a second heating wire respectively disposed in the upper part and the lower part of the sleeve. In normal conditions, the second heating wire operates while the first heating wire does not operate. When the second heating wire breaks down, the base assembly is unscrewed, the atomization assembly is taken out of the cylindrical casing and overturned to be inserted in the cylindrical casing. This improves the working efficiency of the electronic cigarette.

The atomization assembly comprises a first piece of cotton and a second piece of cotton respectively wrapping the first heating wire and the second heating wire. The cotton can adsorb the condensed e-liquid thus preventing the condensed e-liquid from being inhaled into the users' mouth.

DETAILED DESCRIPTION

To further illustrate, embodiments detailing an electronic cigarette are described below. It should be noted that the following embodiments are intended to describe and not to limit the disclosure.

Figure 1:
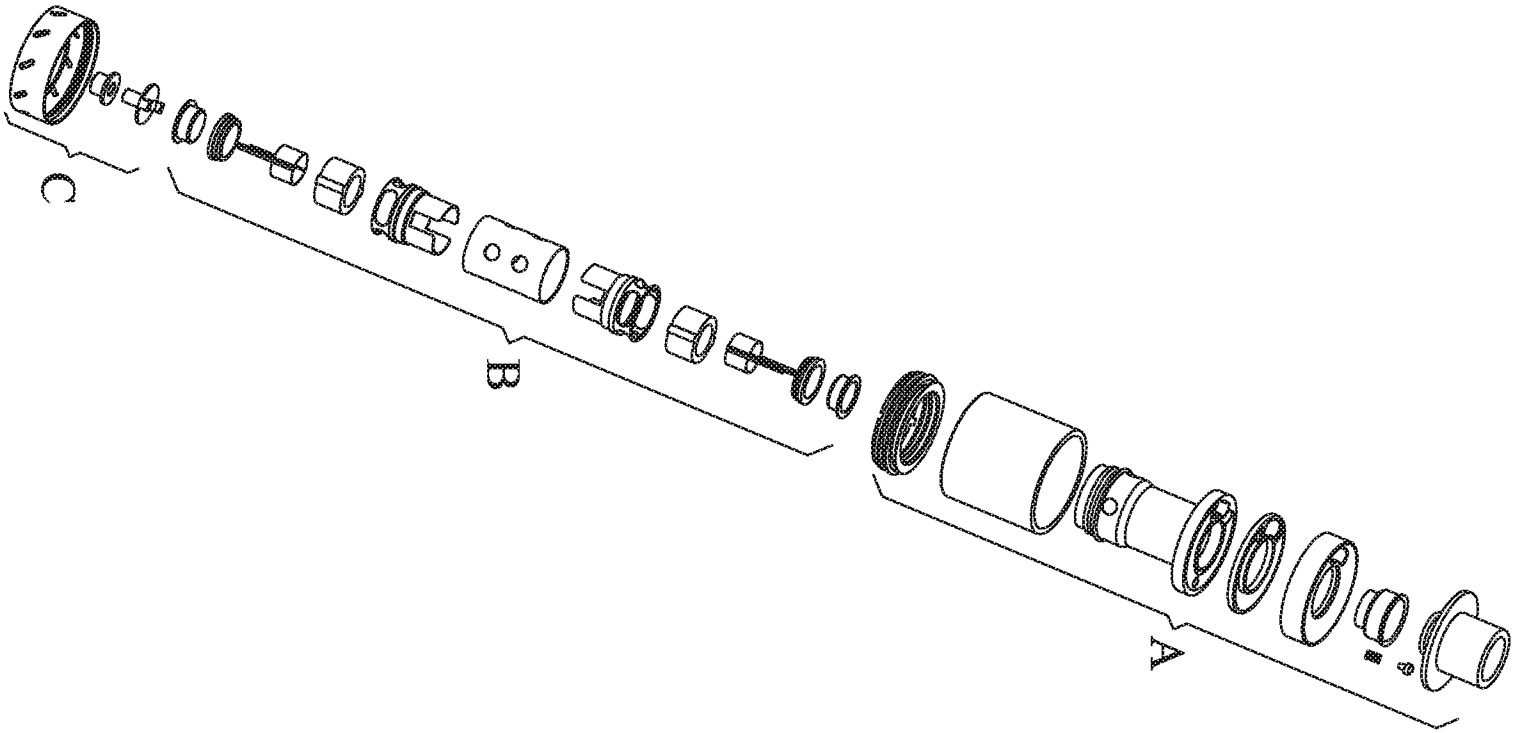
FIG. 1 is an exploded view of an electronic cigarette according to one embodiment of the disclosure.
Figure 2:
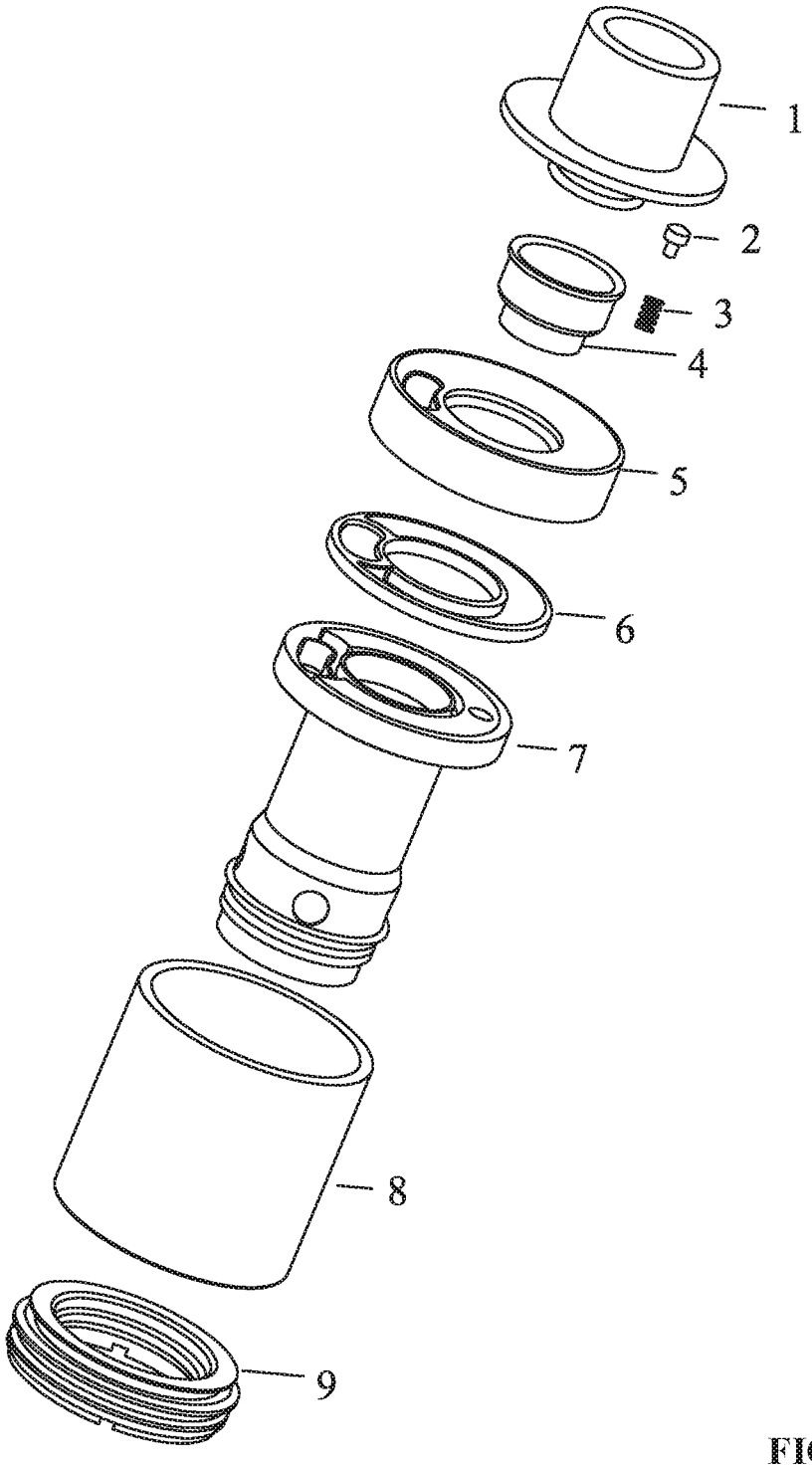
FIG. 2 is an exploded view of a mouthpiece assembly of an electronic cigarette in FIG. 1.
Figure 3:
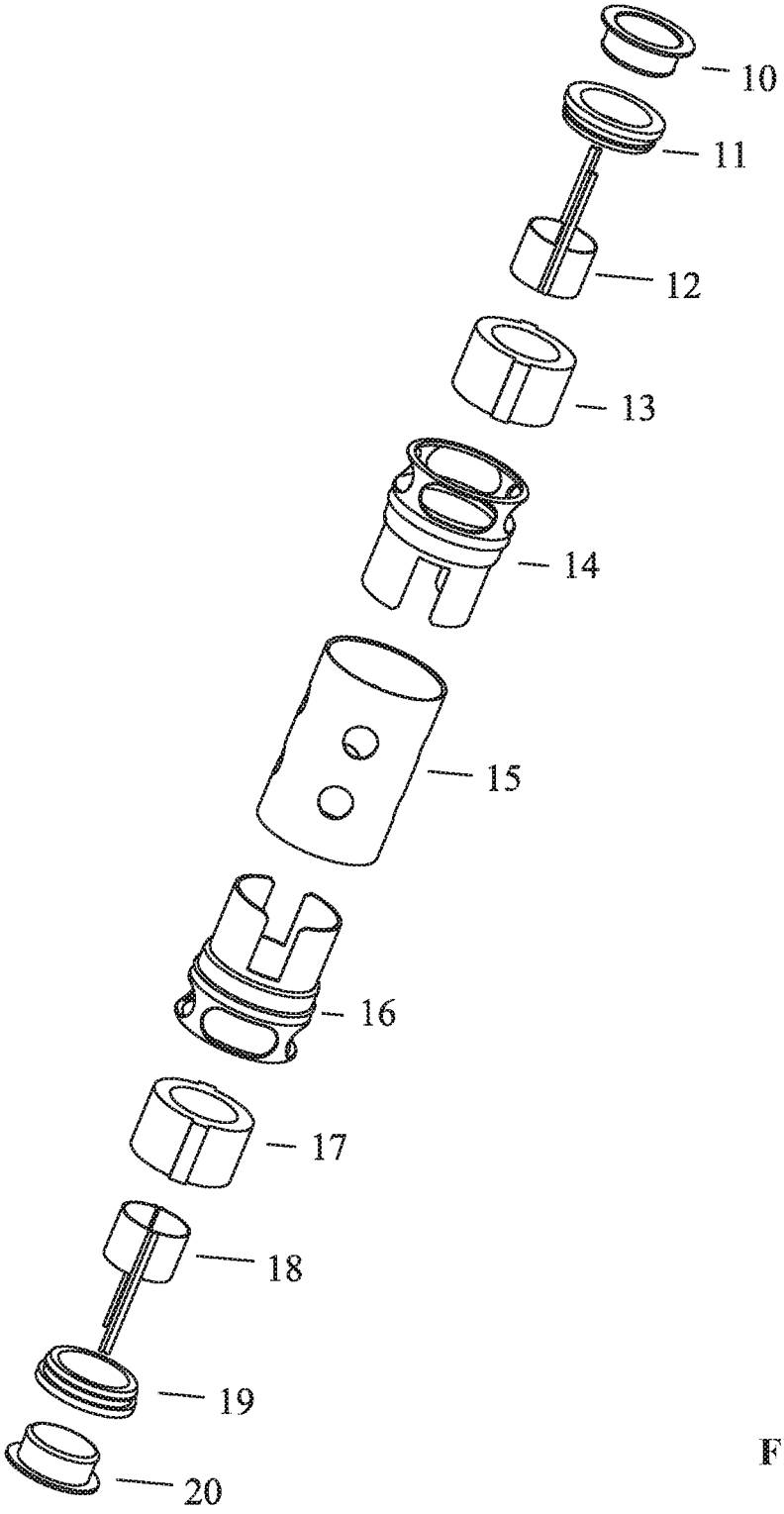
FIG. 3 is an exploded view of an atomization assembly of an electronic cigarette in FIG. 1.
Figure 4:
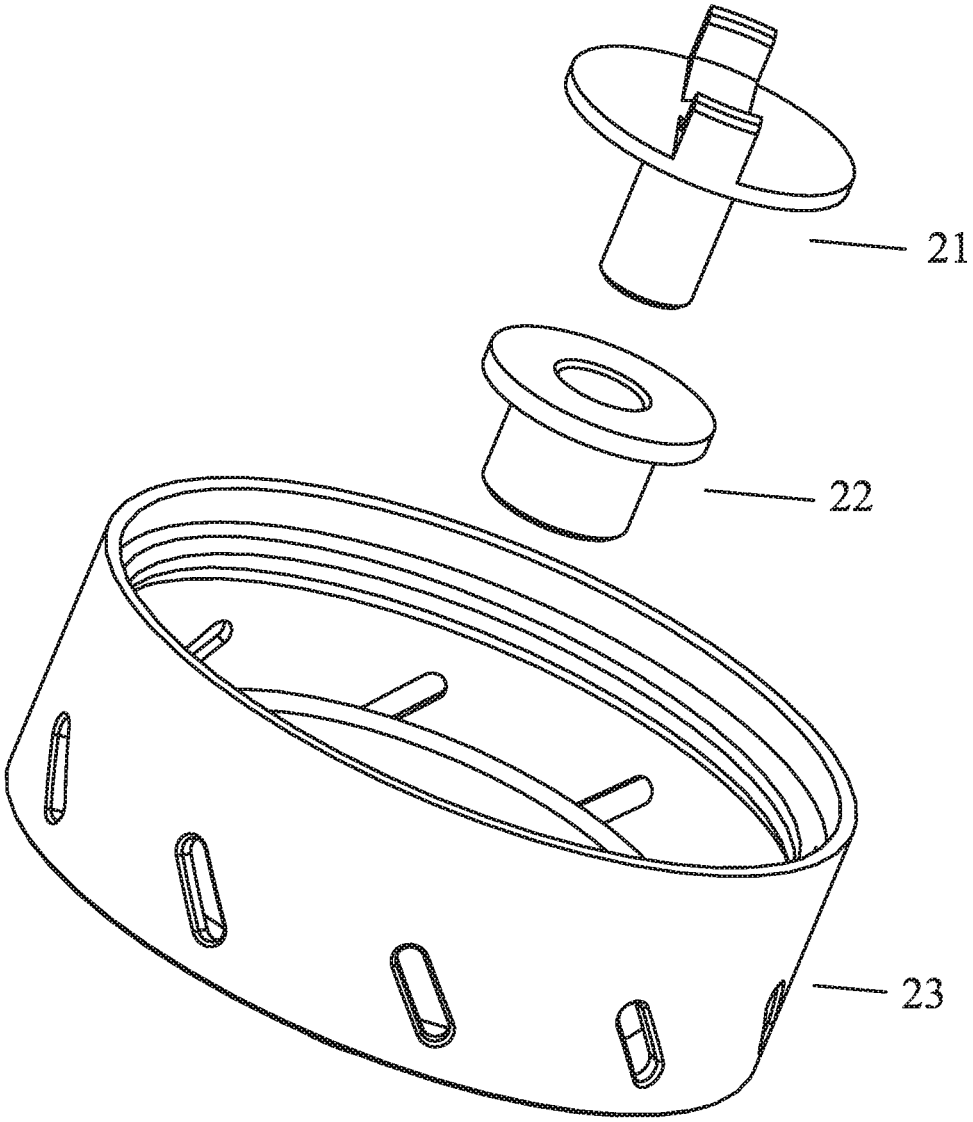
FIG. 4 is an exploded view of abase assembly of an electronic cigarette in FIG. 1.
Figure 5:
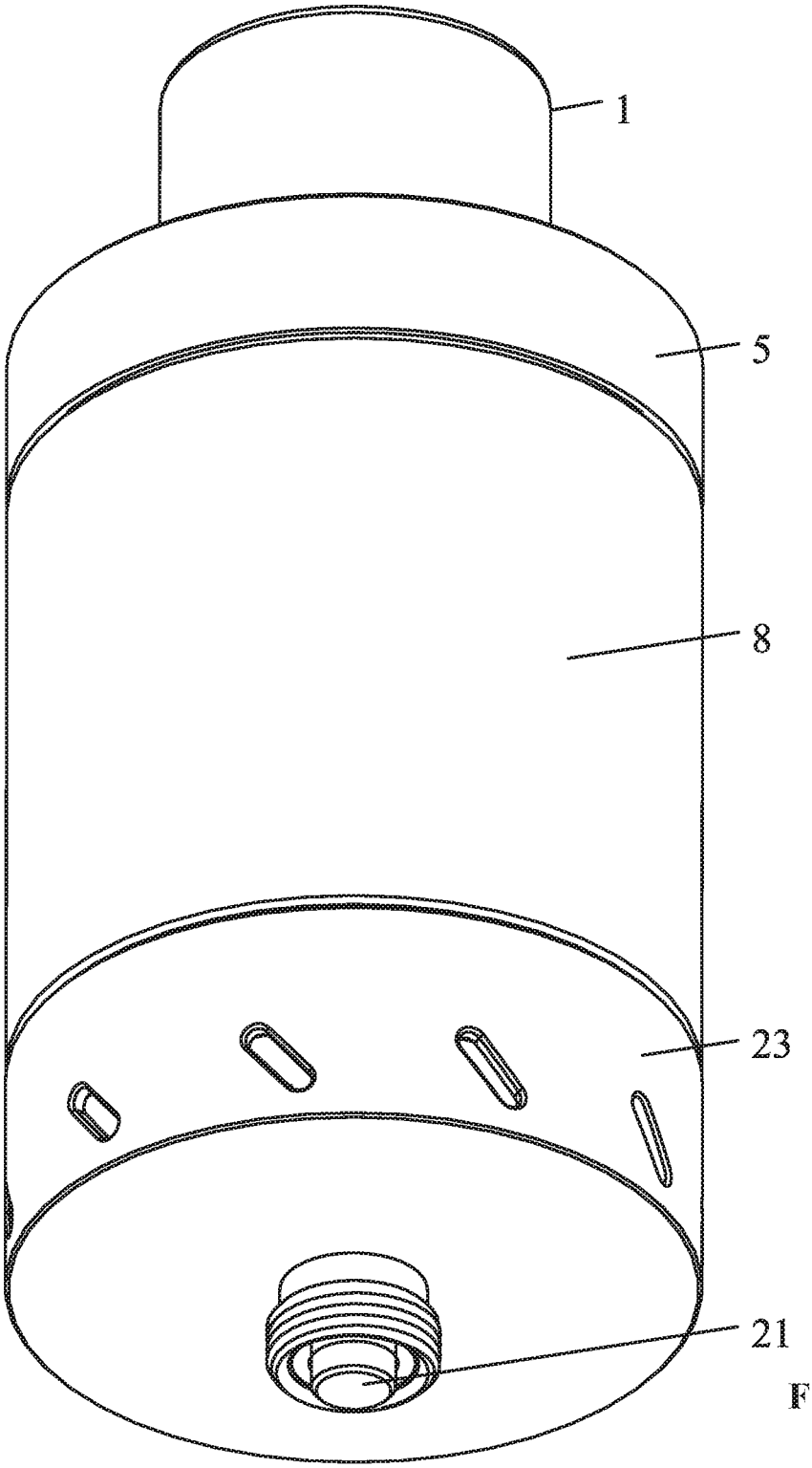
FIG. 5 is a stereogram of an electronic cigarette according to one embodiment of the disclosure.
Figure 6:
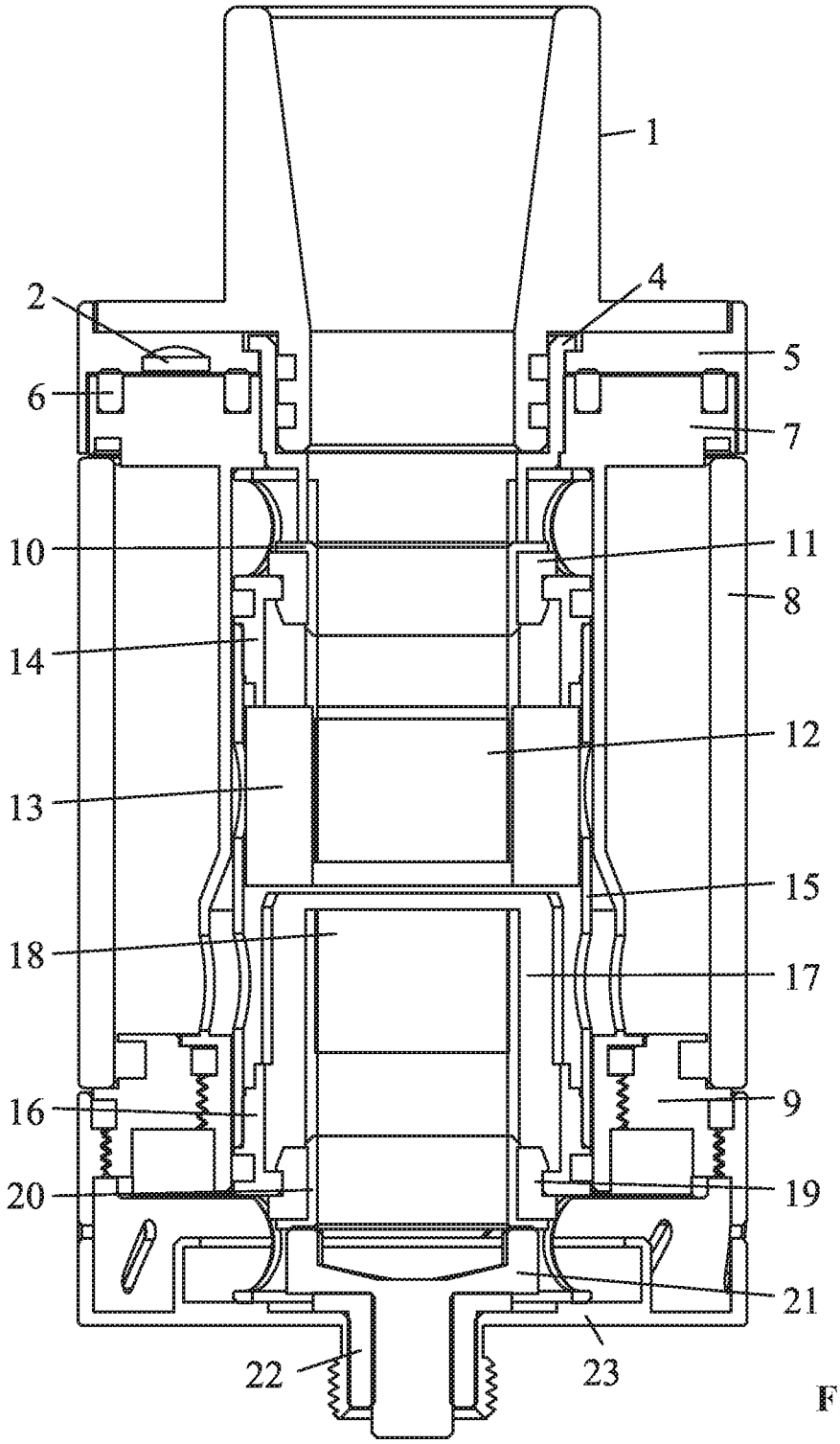
FIG. 6 is a sectional view of an electronic cigarette according to one embodiment of the disclosure.

As shown in FIGS. 1-6, an electronic cigarette comprises a mouthpiece assembly A, an atomization assembly B and a base assembly C.

The mouthpiece assembly A comprises a mouthpiece 1; a limited post 2; a spring 3; a fixed ring 4; an upper cover 5 that is rotatable; a silicone ring 6; a cylindrical casing 7; a glass tube 8; a lower cover 9.

The atomization assembly B comprises a first electrode 10; a first sealing joint 11; a first heating wire 12; a first piece of cotton 13; a first fixed seat 14; a sleeve 15; a second fixed seat 16; a second piece of cotton 17; a second heating wire 18; a second sealing joint 19; a second electrode 20.

The base assembly C comprises a joint 21; a seal ring 22; and a base cover 23.

The limited post 2 is disposed in the spring 3; the cylindrical casing 7 comprises a flange provided with a locating hole; and the spring 3 is embedded in the locating hole; the fixed ring 4 is disposed in the upper cover 5 to control the rotation of the upper cover 5; the silicone ring 6 is disposed on the cylindrical casing 7; the upper cover 5 is disposed on the silicone ring 6; the cylindrical casing 7 is nested in the glass tube 8; the lower cover 9 is in threaded connection to the cylindrical casing 7 and is disposed on one end of the glass tube 8; the mouthpiece 1 is disposed on the fixed ring 4.

The first piece of cotton 13 wraps the first heating wire 12; the first electrode 10 is disposed on the first sealing joint 11; the first heating wire 12 and the first sealing joint 11 are disposed on two ends of the first fixed seat 14, respectively; the first fixed seat 14 is disposed in an upper part of the sleeve 15; the second piece of cotton 17 wraps the second heating wire 18; the second electrode 20 is disposed on the second sealing joint 19; the second heating wire 18 and the second sealing joint 19 are disposed on two ends of the second fixed seat 16, respectively; the second fixed seat 16 is disposed in a lower part of the sleeve 15; and the seal ring 22 is sheathed on the joint 21; and the base cover 23 comprises a central hole and the seal ring 22 and the joint 21 are disposed in the central hole.

The atomization assembly is disposed in the cylindrical casing of the mouthpiece assembly. The base assembly is in threaded connection to the lower cover of the mouthpiece assembly. The atomization assembly comprises a first heating wire and a second heating wire respectively disposed in the upper part and the lower part of the sleeve. In normal conditions, the second heating wire operates while the first heating wire does not operate. When the second heating wire breaks down, the base assembly is unscrewed, the atomization assembly is taken out of the cylindrical casing and overturned to be inserted in the cylindrical casing. This improves the working efficiency of the electronic cigarette.

The atomization assembly comprises a first piece of cotton and a second piece of cotton respectively wrapping the first heating wire and the second heating wire. The cotton can adsorb the condensed e-liquid thus preventing the condensed e-liquid from being inhaled into the users' mouth.

It will be obvious to those skilled in the art that changes and modifications may be made, and therefore, the aim in the appended claims is to cover all such changes and modifications.

What is claimed is:

1. A device, comprising: a mouthpiece assembly, an atomization assembly and a base assembly; the mouthpiece assembly comprising:

1) a mouthpiece;
2) a limited post;
3) a spring;
4) a fixed ring;
5) an upper cover that is rotatable;
6) a silicone ring;
7) a cylindrical casing;
8) a glass tube; and
9) a lower cover;

the atomization assembly comprising:

10) a first electrode;
11) a first sealing joint;
12) a first heating wire;
13) a first piece of cotton;
14) a first fixed seat;
15) a sleeve;
16) a second fixed seat;
17) a second piece of cotton;
18) a second heating wire;
19) a second sealing joint; and
20) a second electrode;

the base assembly comprising:

21) a joint;
22) a seal ring; and
23) a base cover;

wherein:

the limited post is disposed in the spring; the spring is embedded in the cylindrical casing;

the fixed ring is disposed in the upper cover to control the rotation of the upper cover; the silicone ring is disposed on the cylindrical casing; the upper cover is disposed on the silicone ring;

the cylindrical casing is nested in the glass tube; the lower cover is in threaded connection to the cylindrical casing and is disposed on one end of the glass tube; the mouthpiece is disposed on the fixed ring;

the first piece of cotton wraps the first heating wire; the first electrode is disposed on the first sealing joint; the first heating wire and the first sealing joint are disposed on two ends of the first fixed seat, respectively; the first fixed seat is disposed in an upper part of the sleeve;

the second piece of cotton wraps the second heating wire; the second electrode is disposed on the second sealing joint; the second heating wire and the second sealing joint are disposed on two ends of the second fixed seat, respectively; the second fixed seat is disposed in a lower part of the sleeve; and the seal ring is sheathed on the joint; and the base cover comprises a central hole and the seal ring and the joint are disposed in the central hole.

* * * * *